US007077365B2

(12) United States Patent
Vincak

(10) Patent No.: US 7,077,365 B2
(45) Date of Patent: Jul. 18, 2006

(54) WORK STAND

(76) Inventor: John M. Vincak, P.O. Box 7991, Citrus Heights, CA (US) 95621

( * ) Notice: Subject to any disclaimer, the term of this patent is extended or adjusted under 35 U.S.C. 154(b) by 0 days.

(21) Appl. No.: 10/659,731

(22) Filed: Sep. 10, 2003

(65) Prior Publication Data

US 2005/0051679 A1 Mar. 10, 2005

(51) Int. Cl.
*A47F 5/00* (2006.01)

(52) U.S. Cl. ..... 248/122.1; 269/55

(58) Field of Classification Search ..... 248/150, 248/166, 436, 464, 463; 211/169, 169.1, 211/170, 195, 198, 200, 206; 209/54.1, 54.5; 269/905, 52, 54.2, 54.4; 118/502; 5/120, 5/127, 128, 129, 130

See application file for complete search history.

(56) References Cited

U.S. PATENT DOCUMENTS

| | | | | |
|---|---|---|---|---|
| 458,852 | A * | 9/1891 | Larew | 434/413 |
| 1,071,541 | A * | 8/1913 | Young | 5/129 |
| 2,675,981 | A * | 4/1954 | Ferris | 248/166 |
| 4,239,197 | A * | 12/1980 | Olstad | 269/68 |
| 4,757,563 | A * | 7/1988 | An | 5/121 |
| 5,046,203 | A * | 9/1991 | de Cuadros | 5/128 |
| 6,338,758 | B1 * | 1/2002 | Curran | 118/500 |
| 6,561,470 | B1 * | 5/2003 | Webb et al. | 248/201 |
| 6,588,863 | B1 * | 7/2003 | DeWitt et al. | 312/140.4 |
| 6,641,668 | B1 * | 11/2003 | Edgerton | 118/500 |

FOREIGN PATENT DOCUMENTS

| | | | | |
|---|---|---|---|---|
| DE | 4020033 | A1 * | 1/1992 | 248/166 |

* cited by examiner

*Primary Examiner*—Robert P. Olszewski
*Assistant Examiner*—Timothy Smith
(74) *Attorney, Agent, or Firm*—National IP Rights Center

(57) ABSTRACT

A work stand includes a first support section, having a first end and a second end, and a second support section, having a first end and a second end. An elongated brace, having a first end and a second end, the first end of the elongated brace is disposed on the first support section proximate to the first end of the first support section, and the second end of the elongated brace is disposed on the second support section proximate to the first end of the second support section. A first rotatable mount is disposed upon the first support section proximate to the second end of the first support section, and a second rotatable mount is disposed upon the second support section proximate to the second end of the second support section.

5 Claims, 3 Drawing Sheets

WORK STAND

FIELD OF THE INVENTION

The present invention is directed toward work stands, and in particular toward a work stand where a household door may be prepared and painted on both sides.

BACKGROUND OF THE INVENTION

Preparing a door for hanging in a doorframe requires that a person have access to both sides of the door as well as each edge of the door. One way to accomplish this is to lay the door flat on the ground while preparing one side, then flipping it over to prepare the other side. While this may work for some of the preparation work, such as sanding, mounting doorknobs, locks, and hinges, painting cannot be performed at the same time in such a way. One would have to wait for the paint to dry on the one side before flipping the door over and painting the other side. To this end, various products have entered the market to provide a means for supporting an object to be painted and the like.

For example, U.S. Pat. No. 5,181,686 discloses a support housing includes a plurality of radially projecting arm members mounted to the support housing, with the arm members formed of a first and second arm each slidable relative to one another, with each arm including an orthogonally and upwardly oriented projection. A modification of the invention includes projections formed with a polymeric spring-biased tip to resiliently support a workpiece minimizing marring of the workpiece during a drying procedure.

U.S. Pat. No. 4,824,063 is directed to a drying board which supports a freshly coated article during drying and includes a plurality of rigid projections extending upward from a rigid support structure. Each projection has base connected to the support structure and terminates in an upper end. The projection upper ends define a support plane for supporting a freshly coated article during drying. The projections are spaced apart to allow air flow to the supported side of the coated article. In an exemplary embodiment, the projections are randomly positioned such as not to present a pattern on the object and yet to provide a substantially uniform support area for said support plane. The projections are asymmetrically positioned relative to the perimeter of the support structure such that one drying board may be inverted and stacked upon another such that their perimeters are congruent and such that the projections do not interfere with one another.

U.S. Pat. No. 6,575,213 discloses a work support including a frame and a header coupled to the frame and moveable between a first position and a second position. The header includes a first work surface deployed when the header is in a first position and a second work surface deployed when the header is in a second position.

U.S. Pat. No. 6,158,701 is directed to a painting stand for vehicle parts includes a base frame supported by a plurality of casters together with a vertically supported post. A post extension is telescopically supported within the vertical post and is adjustable in its elevation. The upper end of the post extension is coupled to a pivotal support which in turn supports an arm and an elongated handle. The arm is joined to a pair of spaced apart generally parallel cross members. A pair of angularly disposed wings having curved lower ends are joined to the cross members and support respective elongated attachment bars extending between the curved lower ends and the uppermost cross member. Each attachment bar defines a plurality of apertures which facilitate securing various automotive or other vehicle body parts and components to the support rack formed by the cross members and angled wings.

Also, U.S. Pat. No. 6,409,128 discloses a painting stand for vehicle parts includes a base frame supported by a plurality of casters together with a vertically supported post. A post extension is telescopically supported within the vertical post and is adjustable in its elevation. The upper end of the post extension is coupled to a pivotal support which in turn supports an arm and an elongated handle. The arm is joined to a pair of spaced apart generally parallel cross members. A pair of angularly disposed wings having curved lower ends are joined to the cross members and support respective elongated attachment bars extending between the curved lower ends and the uppermost cross member. Each attachment bar defines a plurality of apertures which facilitate securing various automotive or other vehicle body parts and components to the support rack formed by the cross members and angled wings.

There is a need, however, for a work stand that will allow a person to place a household door on a stand to quickly and completely prepare it for hanging, and will allow all work done to the door to be done at relatively the same time.

OBJECTS AND SUMMARY OF THE INVENTION

It is an object of the present invention to provide a work stand for supporting a workpiece having a support section and a rotatable mount for mounting a workpiece to be rotated so that the workpiece may have all sides and edges worked on without having to physically remove the workpiece from the work stand.

It is a further object of the present invention to provide a work stand for supporting a workpiece to be rotated that includes a first support section, a second support section, and an elongated brace to stabilize the first and second support sections. Also, the work stand would have a first rotatable mount on the first support section, and a second rotatable mount on the second support section to rotatably support a workpiece, such as a door.

It is yet a further object of the present invention to provide a work stand for rotatably supporting a workpiece that is collapsible and easily stored.

Therefore, in accordance with a first aspect of the present invention, a novel work stand for rotatably supporting a workpiece is provided. The work stand includes a first support section, and a first rotatable mount, disposed upon the first support section for mounting a workpiece that can be rotated.

In accordance with another aspect of the present invention, a novel work stand with increased stability for rotatably supporting a workpiece is provided. The novel work stand includes a first support section, having a first end and a second end, a second support section, having a first end and a second end, and an elongated brace, having a first end and a second end. The first end of the elongated brace is disposed on the first support section proximate to the first end of the first support section, and the second end of the elongated brace is disposed on the second support section proximate to the first end of the second support section. The work stand further includes a first rotatable mount, disposed upon the first support section proximate to the second end of the first support section, and a second rotatable mount, disposed upon the second support section proximate to the second end of the second support section.

In accordance with yet another aspect of the present invention, a novel collapsible work stand for rotatably supporting a workpiece is provided. The novel collapsible work stand includes a first support section, having a first leg and a second leg, the first leg and the second leg of the first support section each having a first end and a second end, wherein the second end of the first leg and the second end of the second leg are substantially together and the first end of the first leg and the first end of the second leg are substantially apart. The work stand also includes a second support section, having a first leg and a second leg, the first leg and the second leg of the second support section each having a first end and a second end, wherein the second end of the first leg and the second end of the second leg are substantially together and the first end of the first leg and the first end of the second leg are substantially apart, a first support brace, having a first end and a second end, wherein the first end of the first support brace is connected to the first leg of the first support section proximate to the first end of the first leg of the first support section, and the second end of the first support brace is connected to the second leg of the first support section proximate to the first end of the second leg of the first support section. A second support brace, having a first end and a second end, wherein the first end of the second support brace is connected to the first leg of the second support section proximate to the first end of the first leg of the second support section, and the second end of the second support brace is connected to the second leg of the second support section proximate to the first end of the second leg of the second support section is provided. Additionally provided is a first elongated brace, having a first elongated member and a second elongated member, the first elongated member of the first elongated brace having a first end and a second end, and the second elongated member of the first elongated brace having a first end and a second end, wherein the first end of the first elongated member of the first elongated brace is pivotally attached to the first leg of the first support section proximate to the first end of the first leg of the first support section, the first end of the second elongated member of the first elongated brace is pivotally attached to the first leg of the second support section proximate to the first end of the first leg of the second support section, and the second end of the first elongated member of the first elongated brace is pivotally attached to the second end of the second elongated member of the first elongated brace, and a second elongated brace, having a first elongated member and a second elongated member, the first elongated member of the second elongated brace having a first end and a second end, and the second elongated member of the second elongated brace having a first end and a second end, wherein the first end of the first elongated member of the second elongated brace is pivotally attached to the second leg of the first support section proximate to the first end of the second leg of the first support section, the first end of the second elongated member of the second elongated brace is pivotally attached to the second leg of the second support section proximate to the first end of the second leg of the second support section, and the second end of the first elongated member of the second elongated brace is pivotally attached to the second end of the second elongated member of the second elongated brace.

BRIEF DESCRIPTION OF THE DRAWINGS

The foregoing summary, as well as the following detailed description of a preferred embodiment of the present invention will be better understood when read with reference to the appended drawings, wherein.

DETAILED DESCRIPTION OF THE PREFERRED EMBODIMENT

Figure 1:
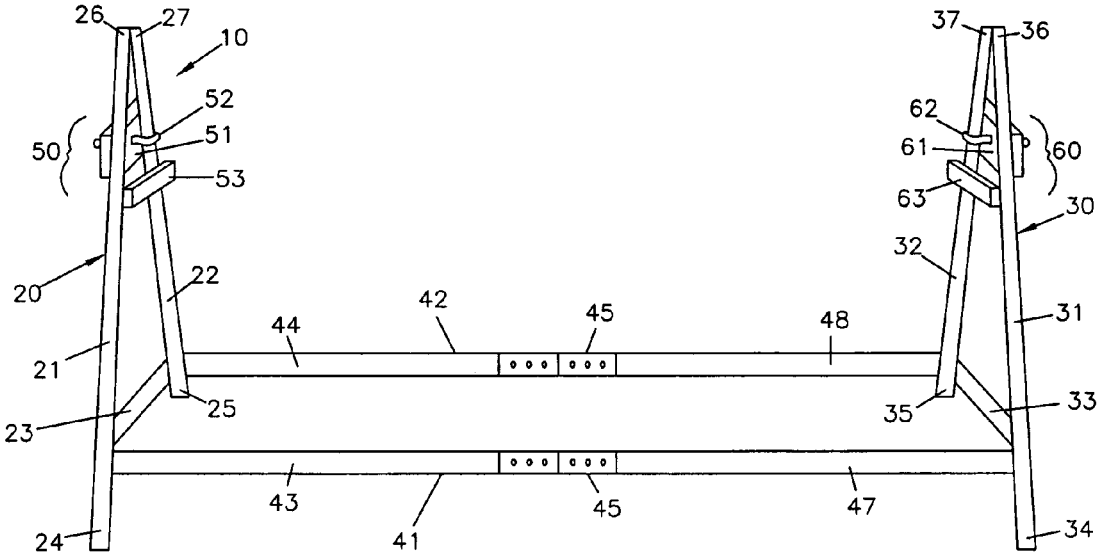
FIG. 1 is a front perspective view of a work stand in accordance with the present invention.
Figure 2:
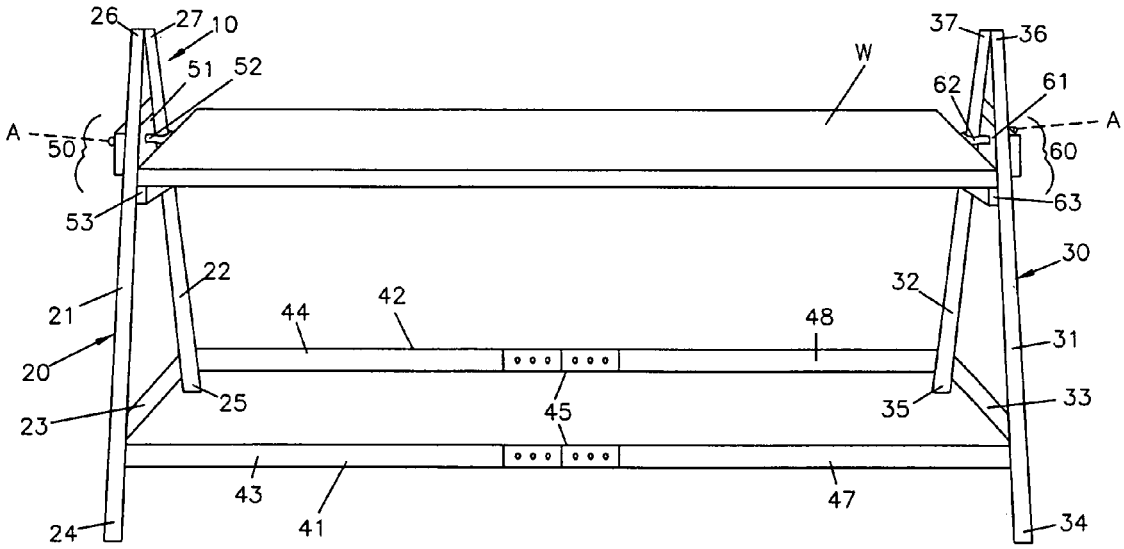
FIG. 2 is a front perspective view of the work stand of FIG. 1 showing a workpiece situated on the work stand.

Referring now to the drawings, wherein like reference numerals refer to the same components across the several views, and in particular to FIGS. 1 and 2, there is shown a work stand 10. The work stand 10 includes a first support section 20, a second support section 30, a first elongated brace 41, a second elongated brace 42, a first mounting section 50, and a second mounting section 60.

The first support section 20 includes a first leg 21, a second leg 22, and a horizontal support brace 23. The first leg 21 has a first end 24 and a second end 26. The second leg 22 has a first end 25 and a second end 27. The second end 26 of the first leg 21 is connected to the second end 27 of the second leg 22 at the top of the first support section 20. One end of the horizontal support brace 23 is disposed upon the first leg 21 proximate to the first end 24 of the first leg 21, while the other end of the horizontal support brace 23 is disposed upon the second leg 22 proximate to the first end 25 of the second leg 22, generally forming an "A" or triangle frame in the first support section 20.

The first mounting section 50 is disposed upon the first support section 20 generally proximate to the second ends 26 and 27 of the first leg 21 and the second leg 22, respectively. Structurally, the first mounting section 50 includes a first mounting brace 51, a first rotatable mount 52, and a first movable support 53. The first mounting brace 51 of the first mounting section 50 is mounted on the exterior of the first support section 20 generally parallel to the horizontal support brace 23, and generally straddling the first leg 21 and the second leg 22 of the first support section 20. The first rotatable mount 52 is substantially cylindrical in shape, and is disposed upon the first mounting brace 51 generally centrally, proceeding perpendicularly outward therefrom. The first rotatable mount 52 penetrates the first mounting brace 51 so as to allow the first rotatable mount 52 to rotate about its axis. Removably mounted on the first support section 20, is the first movable support 53. The first movable support 53 is removably mounted on the interior of the first support section 20 so as to support an end of a workpiece 'W', such as a door. However, the first movable support 53 may be removably mounted on the exterior of the first support section 20. In both configurations, the first movable support 53 is mounted generally beneath the first rotatable mount 52.

The second support section 30 is substantially the same in structure to the first support section 20 and includes a first leg 31, a second leg 32, and a horizontal support brace 33. The first leg 31 has a first end 34 and a second end 36. The second leg 32 has a first end 35 and a second end 37. The second end 36 of the first leg 31 is connected to the second end 37 of the second leg 32 at the top of the second support section 30. One end of the horizontal support brace 33 is disposed upon the first leg 31 proximate to the first end 34 of the first leg 31, while the other end of the horizontal support brace 33 is disposed upon the second leg 32 proximate to the first end 35 of the second leg 32, generally forming an "A" or triangle frame in the second support section 30.

The second mounting section 60 is disposed upon the second support section 30 generally proximate to the second ends 36 and 37 of the first leg 31 and the second leg 32, respectively. Structurally, the second mounting section 60 includes a second mounting brace 61, a second rotatable mount 62, and a second movable support 63. The second mounting brace 61 of the second mounting section 60 is mounted on the exterior of the second support section 30 generally parallel to the horizontal support brace 33, and generally straddling the first leg 31 and the second leg 32 of the second support section 30. The second rotatable mount 62 is substantially cylindrical in shape, and is disposed upon the second mounting brace 61 generally centrally, proceeding perpendicularly outward therefrom. The second rotatable mount 62 penetrates the second mounting brace 61 so as to allow the second rotatable mount 62 to rotate about its axis. Removably mounted on the second support section 30, is the second movable support 63. The second movable support 63 is removably mounted on the interior of the second support section 30 so as to support an end of a workpiece 'W', such as a door. However, the second movable support 63 may be removably mounted on the exterior of the second support section 30. In both configurations, the second movable support 63 is mounted generally beneath the second rotatable mount 62.

The first elongated brace 41 includes a first elongated member 43 and a second elongated member 47. The first elongated member 43 and the second elongated member 47 each have a first and second end. The first end of the first elongated member 43 is pivotally mounted on the first leg 21 of the first support section 20 proximate the first end 24 of the first leg 21, and proceeding generally outward therefrom. The first end of the second elongated member 47 is pivotally mounted on the first leg 31 of the second support section 30 proximate to the first end 34 of the first leg 31, and proceeding generally outward therefrom. The first elongated member 43 and second elongated member 47 are pivotally connected to each other at their second ends by virtue of a hinge 45, disposed at the second ends of the first elongated member 43 and the second elongated member 47.

The second elongated brace 42 includes a first elongated member 44 and a second elongated member 48. The first elongated member 44 and the second elongated member 48 each have a first and second end. The first end of the first elongated member 44 is pivotally mounted on the second leg 22 of the first support section 20 proximate the first end 25 of the second leg 22, and proceeding generally outward therefrom. The first end of the second elongated member 48 is pivotally mounted on the second leg 32 of the second support section 30 proximate to the first end 35 of the second leg 32, and proceeding generally outward therefrom. The first elongated member 44 and second elongated member 48 are pivotally connected to each other at their second ends by virtue of a hinge 45, disposed at the second ends of the first elongated member 44 and the second elongated member 48. In this manner, the first elongated brace 41 and the second elongated brace 42 can be swung upward at their midpoints to collapse the work stand 10. In this extended configuration of the work stand 10, the first support section 20 and the second support section 30 are stably held in a parallel configuration apart from one another to receive the workpiece 'W' to be worked on. In a preferred embodiment of the present invention, hinges 45 are used to provide the means for pivoting about the second ends of the first elongated members 43 and 44, and the second elongated members 47 and 48. Likewise, hinges may be used at the first ends of the first elongated members 43 and 44, and the second elongated members 47 and 48 to pivotally attach them to the first section 20 and the second support section 30, respectively. However, various other means known to one of ordinary skill in the art may be employed to provide the pivoting required to collapse and extend the work stand 10, such as, and not limited to, the use of a rotatable dowel or peg at the pivot points.

Referring now to FIG. 2, the workpiece 'W' is shown mounted on the work stand 10. The workpiece 'W' may, for example, be a door, however various other workpieces may be worked upon with the work stand 10. A first edge of the workpiece 'W' is shown mounted on the first rotatable mount 52, and a second edge of the workpiece 'W' is shown mounted on the second rotatable mount 62. In a preferred embodiment of the present invention, holes may be drilled into the first and second edges of the workpiece 'W' to receive the first rotatable mount 52 and the second rotatable mount 62, respectively. In the present configuration, the workpiece 'W' is shown with the first edge resting on the first movable support 53 and the second edge of the workpiece 'W' is shown resting on the second movable support 63. In this configuration, the workpiece 'W' is held generally rigidly in place to facilitate a variety of operations upon the workpiece 'W', such as painting, sanding, and installing locks, doorknobs, and hinges, to name a few. Additionally, the first movable support 53 and the second movable support 63 may be moved to the exteriors of the first support section 20 and the second support section 30, respectively. In this mode, the workpiece 'W' may be rotated about its axis 'A' to allow access to either side of the workpiece 'W', without having to physically remove the workpiece 'W' from the work stand 10. Although in a preferred embodiment of the present invention, the workpiece 'W' is mounted upon the first rotatable mount 52 and the second rotatable mount 62 by means of the first and second rotatable mounts 52 and 62 being inserted into drilled holes in the edges of the workpiece 'W', any means of mounting the workpiece 'W' known to one of ordinary skill in the art may be employed. For example, the edges of the workpiece 'W' may be mounted on the first and second rotatable mounts 52 and 62 by clamps situated at the ends of the first rotatable mount 52 and second rotatable mount 62.

Figure 3:
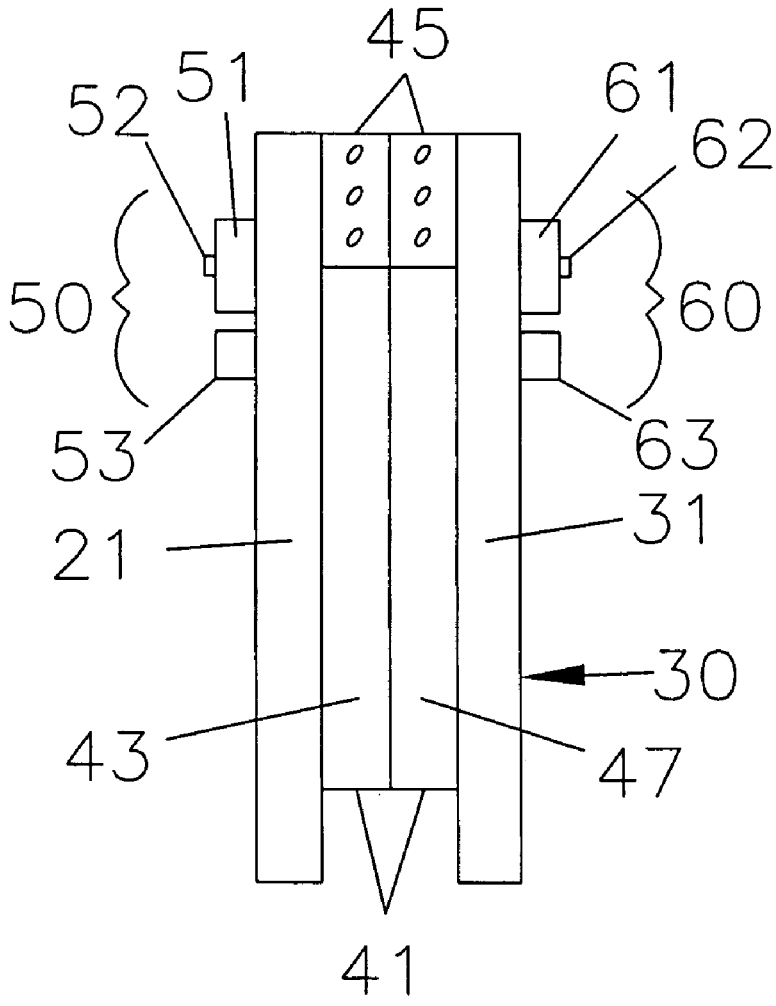
FIG. 3 is a front elevation of the work stand of FIG. 1 in a collapsed configuration.

Referring now to FIG. 3, the work stand 10 is shown in the collapsed configuration for easy storage. By swinging the first elongated brace 41 and the second elongated brace 42 about their hinges 45, the first support section 20 and the second support section 30 can be brought substantially together. In this configuration, the work stand 10 takes up far less space than in the fully extended configuration, thereby facilitating storage of the unit.

In view of the foregoing disclosure, some of the advantages of the present invention can be seen. For instance, a novel work stand is disclosed. The novel work stand allows a worker to perform operations upon any side or edge of a workpiece, such as a door, without having to physically remove the workpiece from the work stand. Additionally, the work stand can be substantially collapsed to facilitate storage of the work stand.

While the preferred embodiments of the present invention have been described and illustrated, modifications may be made by one of ordinary skill in the art without departing from the scope and spirit of the invention as defined in the appended claims. For example, in a preferred embodiment of the present invention, the work stand is formed of metal, such as aluminum or steel. However, the work stand can also be formed of materials such as wood, or any other material known to one of ordinary skill in the art that will render the work stand functional. Additionally, the rotatable mounts are described as being substantially cylindrical, but any shape known to one of ordinary skill in the art may be employed to mount the workpiece on so that it may be rotated about an axis.

What is claimed is:

1. A work stand for supporting a workpiece, comprising:

a first support section, having a first end and a second end;

a second support section, having a first end and a second end;

an elongated brace, having a first end and a second end, the first end of the elongated brace disposed on the first support section proximate to the first end of the first support section, and the second end of the elongated brace disposed on the second support section proximate to the first end of the second support section;

a first rotatable mount, disposed upon the first support section proximate to the second end of the first support section, whereto a first end of a workpiece can be removably attached to said first rotatable mount;

a second rotatable mount, disposed upon the second support section proximate to the second end of the second support section, whereto a second end of the workpiece can be removably attached to said second rotatable mount, so that when the workpiece is removably attached to both the first and second rotatable mounts it is capable of being rotated no less than 180 degrees about the axis between said rotatable mounts;

a first movable support, disposed upon the first support section proximate to the first rotatable mount, wherein the first end of the workpiece can be locked into a position when placed in contact with the first movable support; and a second movable support, disposed upon the second support section proximate to the second rotatable mount, wherein the second end of the workpiece can be locked into a position when placed in contact with the second movable support.

2. The work stand of claim 1, wherein the first movable support is disposed upon the first support section beneath the first rotatable mount, and the second movable support is disposed upon the second support section beneath the second rotatable mount.

3. The work stand of claim 1, wherein the elongated brace further comprises a first elongated member, having a first end and a second end, and a second elongated member, having a first end and a second end, whereby the first end of the first elongated member is pivotally attached to the first support section proximate to the first end of the first support section, the first end of the second elongated member is pivotally attached to the second support section proximate to the first end of the second support section, and the second end of the first elongated member is pivotally attached to the second end of the second elongated member.

4. The work stand of claim 3, further comprising a hinge disposed at the second ends of the first and second elongated members, hingedly connecting the first elongated member to the second elongated member.

5. A work stand for supporting a workpiece, comprising:

a first support section, having a first leg and a second leg, the first leg and the second leg of the first support section each having a first end and a second end, wherein the second end of the first leg and the second end of the second leg are substantially together and the first end of the first leg and the first end of the second leg are substantially apart;

a second support section, having a first leg and a second leg, the first leg and the second leg of the second support section each having a first end and a second end, wherein the second end of the first leg and the second end of the second leg are substantially together and the first end of the first leg and the first end of the second leg are substantially apart;

a first support brace, having a first end and a second end, wherein the first end of the first support brace is connected to the first leg of the first support section proximate to the first end of the first leg of the first support section, and the second end of the first support brace is connected to the second leg of the first support section proximate to the first end of the second leg of the first support section;

a second support brace, having a first end and a second end, wherein the first end of the second support brace is connected to the first leg of the second support section proximate to the first end of the first leg of the second support section, and the second end of the second support brace is connected to the second leg of the second support section proximate to the first end of the second leg of the second support section;

a first elongated brace, having a first elongated member and a second elongated member, the first elongated member of the first elongated brace having a first end and a second end, and the second elongated member of the first elongated brace having a first end and a second end, wherein the first end of the first elongated member of the first elongated brace is pivotally attached to the first leg of the first support section proximate to the first end of the first leg of the first support section, the first end of the second elongated member of the first elongated brace is pivotally attached to the first leg of the second support section proximate to the first end of the first leg of the second support section, and the second end of the first elongated member of the first elongated brace is pivotally attached to the second end of the second elongated member of the first elongated brace; and a second elongated brace, having a first elongated member and a second elongated member, the first elongated member of the second elongated brace having a first end and a second end, and the second elongated member of the second elongated brace having a first end and a second end, wherein the first end of the first elongated member of the second elongated brace is pivotally attached to the second leg of the first support section proximate to the first end of the second leg of the first support section, the first end of the second elongated member of the second elongated brace is pivotally attached to the second leg of the second support section proximate to the first end of the second leg of the second support section, and the second end of the first elongated member of the second elongated brace is pivotally attached to the second end of the second elongated member of the second elongated brace;

a first rotatable mount, disposed upon the first support section proximate to the second end of the first support section, whereto a first end of a workpiece can be removably attached to said first rotatable mount:

a second rotatable mount, disposed upon the second support section proximate to the second end of the second support section, whereto a second end of the workpiece can be removably attached to said second rotatable mount, so that when the workpiece is removably attached to both the first and second rotatable mounts it is capable of being rotated no less than 180 degrees about the axis between said rotatable mounts;

a first movable support, disposed upon the first support section proximate to the first rotatable mount, wherein the first end of the workpiece can be locked into a position when placed in contact with the first movable support; and a second movable support, disposed upon the second support section proximate to the second rotatable mount, wherein the second end of the workpiece can be locked into a position when placed in contact with the second movable support.

* * * * *